US009123288B2

(12) United States Patent
Guo et al.

(10) Patent No.: US 9,123,288 B2
(45) Date of Patent: Sep. 1, 2015

(54) DISPLAY DEVICES FOR PROVIDING DRIVING CURRENTS IRRELEVANT TO THRESHOLD VOLTAGES OF DRIVING TRANSISTORS AND DRIVING VOLTAGES OF LIGHT-EMITTING DIODES

(75) Inventors: Hong-Ru Guo, Miao-Li County (TW); Ming-Chun Tseng, Miao-Li County (TW)

(73) Assignees: INNOCOM TECHNOLOGY (SHENZHEN) CO., LTD., Longhua Town, Shenzhen (CN); INNOLUX CORPORATION, Miao-Li County (TW)

( * ) Notice: Subject to any disclaimer, the term of this patent is extended or adjusted under 35 U.S.C. 154(b) by 211 days.

(21) Appl. No.: 13/608,346

(22) Filed: Sep. 10, 2012

(65) Prior Publication Data

US 2013/0120337 A1 May 16, 2013

(30) Foreign Application Priority Data

Nov. 15, 2011 (TW) ..... 100141545 A

(51) Int. Cl.
*G09G 3/32* (2006.01)

(52) U.S. Cl.
CPC ..... *G09G 3/3208* (2013.01); *G09G 2300/0852* (2013.01); *G09G 2300/0861* (2013.01)

(58) Field of Classification Search
CPC . G09G 3/3233; G09G 3/3208; G09G 3/3258; G09G 2320/043; G09G 2320/045
USPC ..... 345/36, 39, 44–46, 74.1–83; 315/169.1–169.4; 313/463, 484–487, 313/498–502
See application file for complete search history.

(56) References Cited

U.S. PATENT DOCUMENTS

| | | | | |
|---|---|---|---|---|
| 7,646,364 | B2 | 1/2010 | Yamashita et al. | |
| 2005/0088378 | A1* | 4/2005 | Ozawa et al. | 345/76 |
| 2009/0027310 | A1* | 1/2009 | Kim | 345/76 |

(Continued)

FOREIGN PATENT DOCUMENTS

| | | |
|---|---|---|
| CN | 1783192 | 6/2006 |
| CN | 101866614 | 10/2010 |

OTHER PUBLICATIONS

Chinese language office action dated Sep. 1, 2014.
English language translation of abstract of CN 1783192 (published Jun. 6, 2006).

(Continued)

*Primary Examiner* — Ram Mistry
(74) *Attorney, Agent, or Firm* — McClure, Qualey & Rodack, LLP

(57) ABSTRACT

A display device includes pixel units. Each pixel unit includes a driving transistor, a switch transistor, a reset transistor, a light-emitting element, and a control unit. The driving transistor has a control terminal, a first terminal coupled to a first operation voltage source and a second terminal. The reset transistor is coupled to the control terminal of the driving transistor. The light-emitting element is coupled to the switch transistor in series between the second terminal of the driving transistor and a second operation voltage source. The control unit stores a threshold voltage of the driving transistor and a driving voltage of the light-emitting element according to a voltage level of the second terminal of the driving transistor. The control unit changes a voltage level of the control terminal of the driving transistor according to the stored threshold voltage, the stored driving voltage, and a corresponding data signal.

7 Claims, 7 Drawing Sheets

(56) References Cited

U.S. PATENT DOCUMENTS

| | | | | |
|---|---|---|---|---|
| 2009/0225013 | A1* | 9/2009 | Lee et al. | 345/80 |
| 2010/0220038 | A1* | 9/2010 | Chung et al. | 345/76 |
| 2010/0265166 | A1 | 10/2010 | Kang et al. | |

OTHER PUBLICATIONS

English language translation of abstract of CN 101866614 (published Oct. 20, 2010).

* cited by examiner

| | T1 | T2 | T3 | T4 |
|---|---|---|---|---|
| VN20 | VRef | VRef | VDS1+Vt | VDS1+Voled+Vt |
| VN21 | 0V | VRef-Vt | F | Voled |
| VN22 | 0V | VRef-Vt | VDS1 | VDS1+Voled |
| VN23 | 0V | 0V | 0V | Voled |

FIG. 4

DISPLAY DEVICES FOR PROVIDING DRIVING CURRENTS IRRELEVANT TO THRESHOLD VOLTAGES OF DRIVING TRANSISTORS AND DRIVING VOLTAGES OF LIGHT-EMITTING DIODES

This Application claims priority of Taiwan Patent Application No. 100141545, filed on Nov. 15, 2011, the entirety of which is incorporated by reference herein.

BACKGROUND OF THE INVENTION

1. Field of the Invention

The invention relates to a display device, and more particularly to a display device which is capable of providing a driving current, which is irrelevant to a threshold voltage of a transistor and a driving voltage of a light-emitting diode, to drive the light-emitting diode.

2. Description of the Related Art

Organic light-emitting diode (OLED) display devices have some advantages, such as a slight size, light weight, high light-emitting efficiency, low driving voltage, and a simple process. Thus, recently, OLED display devices are one of the popular types of flat display devices. According to driving methods, OLED display devices are divided into passive-matrix OLED display (PM-OLED) devices and active-matrix OLED (AM-OLED) display devices. AM-OLED display devices emit light by current driving and use at least one thin-film transistor (TFT) to serve as a switch. The TFT adjusts a current according to the voltage stored in a storage capacitor to control gray levels in different pixel areas.

Further, according to panel process techniques, AM-OLED display devices are divided into P-type driving display devices and N-type driving display devices. However, threshold voltages of TFTs and driving voltages of OLEDs in an active matrix vary as time goes by, resulting in a mura phenomenon to occur in the AM-OLED display devices.

BRIEF SUMMARY OF THE INVENTION

An exemplary embodiment of a display device comprises a plurality of pixel units. Each pixel unit receives a data signal and a scan signal and comprises a driving transistor, a switch transistor, a reset transistor, a light-emitting element, and a control unit. The driving transistor has a control terminal, a first terminal coupled to a first operation voltage source, and a second terminal and further has a threshold voltage. The switch transistor is coupled to the second terminal of the driving transistor. The reset transistor is coupled to the control terminal of the driving transistor and receives a reference voltage signal and a first control signal. The light-emitting element has a driving voltage and is coupled to the switch transistor in series between the second terminal of the driving transistor and a second operation voltage source. The control unit is coupled to the control terminal and the second terminal of the driving transistor and receives the corresponding data signal. The control unit stores the threshold voltage and the driving voltage according to a voltage level of the second terminal of the driving transistor. The control unit changes a voltage level of the control terminal of the driving transistor according to the stored threshold voltage, the stored driving voltage, and the corresponding data signal.

Another exemplary embodiment of a display device comprises a plurality of data lines, a plurality of scan lines, and a display array. The data lines transmit a plurality of data signals, respectively. The scan lines transmit a plurality of scan signals, respectively. The scan lines are interlaced with the data lines, and the scan signals are enabled sequentially. The display array comprises a plurality of pixel units arranged in a matrix formed by a plurality of pixel rows and a plurality of pixel columns. Each pixel unit is coupled to a set of the interlaced data line and scan line to receive the corresponding data signal and the corresponding scan signal. The pixel units arranged on the same pixel column are coupled to the same data line, and the pixel units arranged on the same pixel row are coupled to the same scan line.

Each pixel unit comprises a driving transistor, a switch transistor, a light-emitting element, and a control unit. The driving transistor has a control terminal, a first terminal coupled to a first operation voltage source, and a second terminal and further has a threshold voltage. The switch transistor is coupled to the second terminal of the driving transistor. The light-emitting element has a driving voltage and is coupled to the switch transistor in series between the second terminal of the driving transistor and a second operation voltage source. The control unit is coupled to the control terminal and the second terminal of the driving transistor and receives the corresponding data signal. The control unit stores the threshold voltage and the driving voltage according to a voltage level of the second terminal of the driving transistor. The control unit changes a voltage level of the control terminal of the driving transistor according to the stored threshold voltage, the stored driving voltage, and the corresponding data signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 4 shows voltage levels of terminals of each display unit in each display unit period according to one exemplary embodiment;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
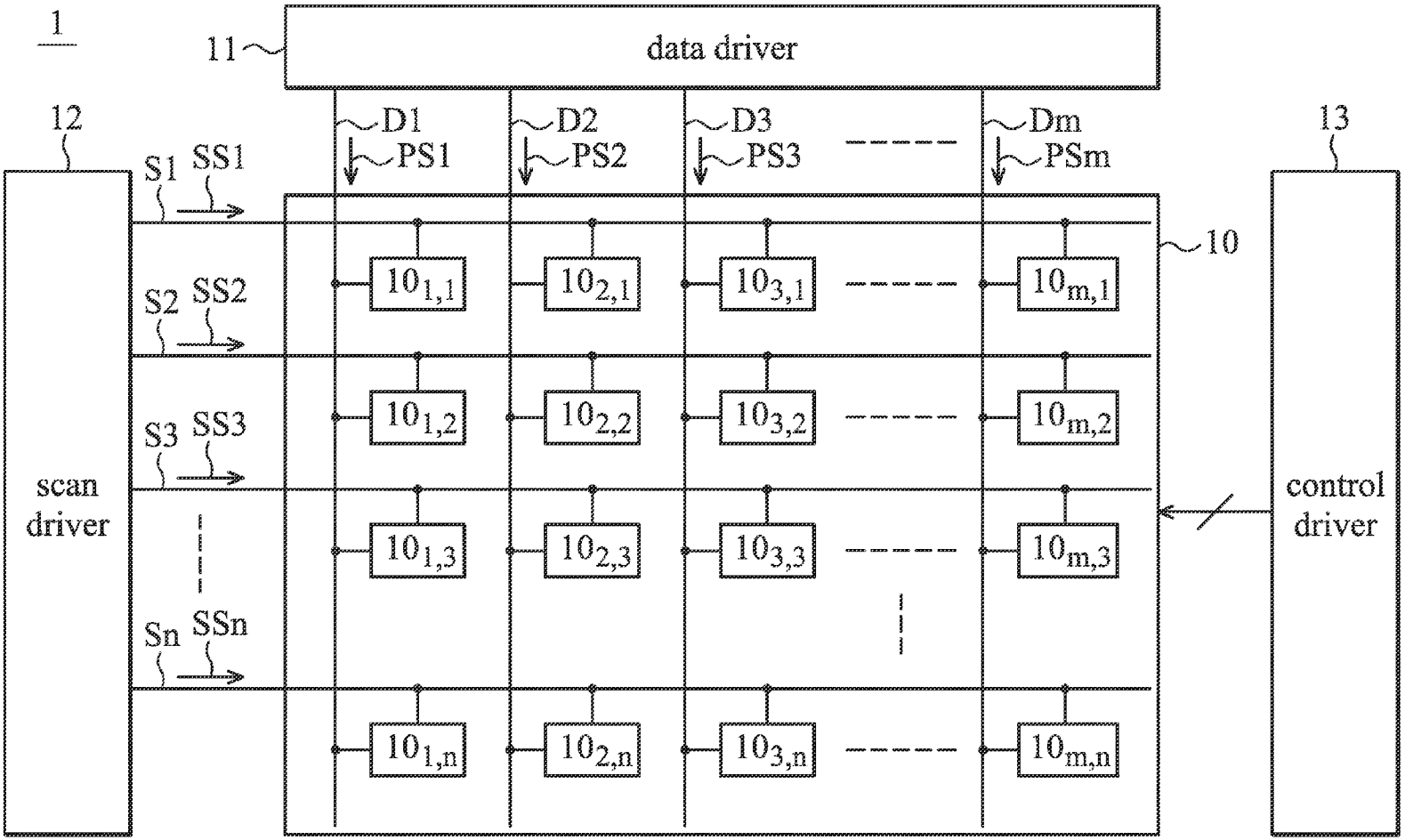
FIG. 1 shows an exemplary embodiment of a display unit.

Display devices are provided. In an exemplary embodiment of a display device in FIG. 1, a display device 1 has a compensation function related to a threshold voltage of a transistor and a driving voltage of a light-emitting diode. Referring to FIG. 1, the display device 1 comprises a display array 10, a data driver 11, a scan driver 12, and a control driver 13. The data driver 11 is coupled to a plurality of data lines D1-Dm and provides a plurality of data signals DS1-DSm to the data lines D1-Dm, respectively. The scan driver 12 is coupled to a plurality of scan lines S1-Sn and provides a plurality of scan signals SS1-SSn to the scan lines S1-Sn, respectively. The scan signals SS1-SSn are enabled sequentially. The lengths of the periods when the respective scan signals SS1-SSn are enabled are equal, and these periods do not overlap. As shown in FIG. 1, the data lines D1-Dm are interlaced with the scan lines S1-Sn.

The display array 10 comprises a plurality of units $10_{1,1}$-$10_{m,n}$ which are arranged in a matrix formed by a plurality of pixel rows and a plurality of pixel columns. Each pixel unit is coupled to a set of the interlaced data line and scan line to receive the corresponding data signal and scan signal. For example, the pixel unit $10_{1,1}$ is coupled to the interlaced data line D1 and scan line S1 to receive the corresponding data signal DS1 and scan signal SS1, and the pixel unit $10_{1,2}$ is coupled to the interlaced data line D1 and scan line S2 to receive the corresponding data signal DS1 and scan signal SS2. Referring to FIG. 1, the pixel units arranged in the same pixel column (along the vertical direction) are coupled to the same data line, and the pixel units arranged in the same pixel row (along the horizontal direction) are coupled to the same scan line. For example, the pixel units $10_{1,1}$-$10_{1,n}$ arranged in the first pixel column are coupled to the data line D1 to receive the data signal DS1, and the pixel units $10_{1,1}$-$10_{m,1}$ arranged in the first pixel row are coupled to the scan line S1 to receive the scan signal SS1. The control driver 13 provides a plurality of signals to the pixel units of the display array 10 to control each pixel unit to perform a compensation function related to a threshold voltage of a transistor and a driving voltage of a light-emitting diode.

Figure 2:
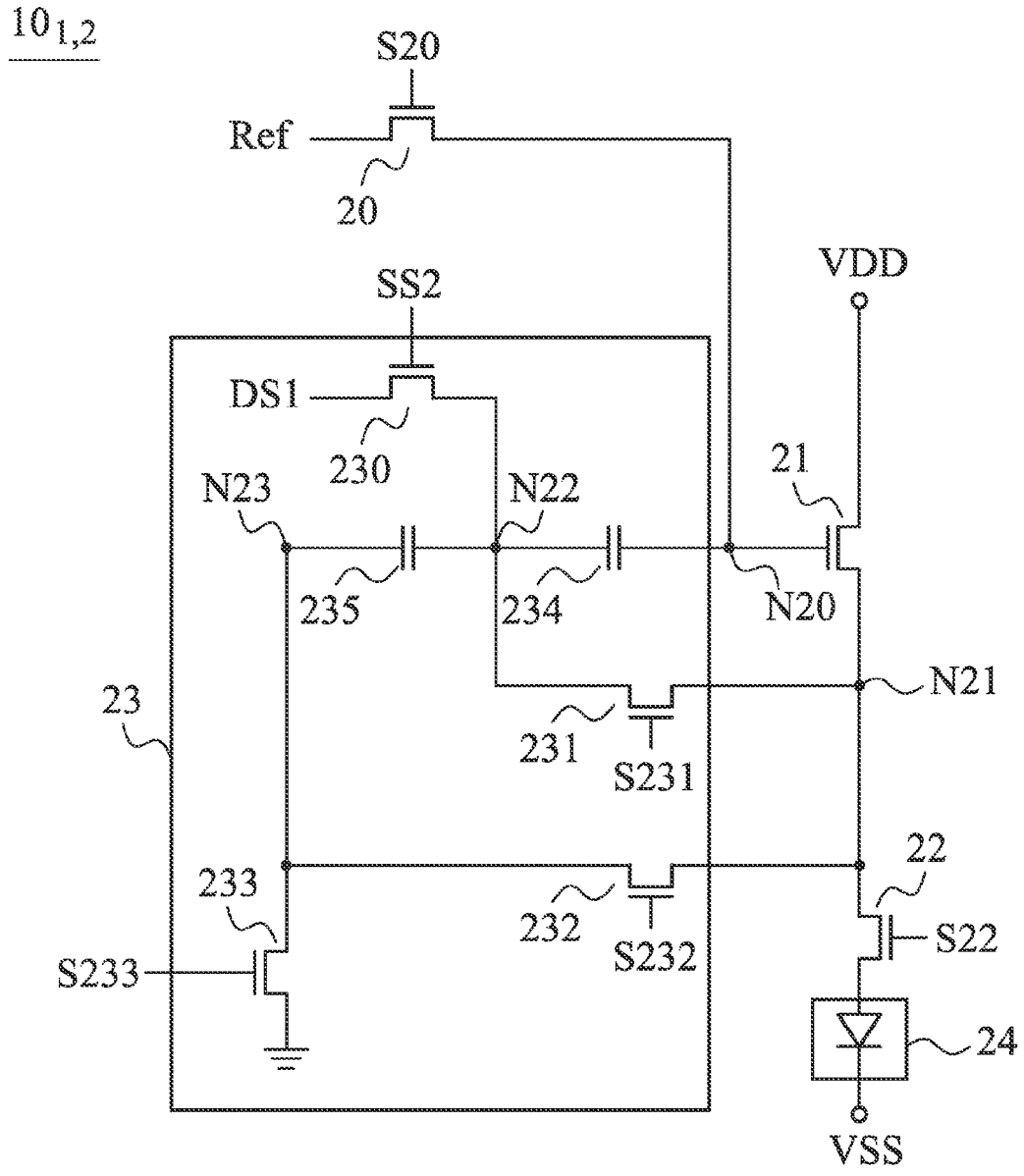
FIG. 2 shows one exemplary embodiment of a pixel unit.

FIG. 2 shows an exemplary embodiment of a pixel unit. The pixel units $10_{1,1}$-$10_{m,n}$ of the display array 10 have the same structure. For clear description, FIG. 2 only shows the pixel unit $10_{1,2}$. As described above, the pixel unit $10_{1,2}$ is coupled to the interlaced data line D1 and scan line S2 to receive the corresponding data signal DS1 and scan signal SS2. Referring to FIG. 2, the pixel unit $10_{1,2}$ comprises a reset transistor 20, a driving transistor 21, a switch transistor 22, a control unit 23, and a light-emitting element 24.

A control terminal of the reset transistor 20 receives a control signal S20, an input terminal thereof receives a reference voltage signal Ref, and an output terminal thereof is coupled to a control terminal N20 of the driving transistor 21. An input terminal (also referred to as a first terminal) of the driving transistor 21 is coupled to an operation voltage source VDD, and an output terminal N21 (also referred to as a second terminal) thereof is coupled to an input terminal of the switch transistor 22. A control terminal of the switch transistor 22 receives a switch signal S22. The switch transistor 22 and the light-emitting element 24 are coupled in series between the output terminal N21 of the driving transistor 21 and an operation voltage source VSS. In detail, the input terminal of the switch transistor 22 is coupled to the output terminal N21 of the driving transistor 21, and the light-emitting element 24 is coupled between an output terminal of the switch transistor 22 and the operation voltage source VSS. In the embodiment, the light-emitting element 22 is implemented by an organic light-emitting diode (OLED), and anode thereof is coupled to the output terminal of the switch transistor 22 and a cathode thereof is coupled to the operation voltage source VSS.

Moreover, in the embodiment, the voltage provided by the operation voltage source VDD is greater than the voltage provided by the operation voltage source VSS.

Referring to FIG. 2, the control unit 23 comprises an input transistor 230, transistors 231-233, and capacitors 234-235. A control terminal of the input transistor 230 is coupled to the scan line S2 which corresponds to the pixel unit $10_{1,2}$ to receive the scan signal SS2, and an input terminal (also referred to as a first terminal) thereof is coupled to the data line D1 which corresponds to the pixel unit $10_{1,2}$ to receive the data signal DS1. The capacitor 234 is coupled between an output terminal N22 (also referred to as a second terminal) of the input transistor 230 and the control terminal N20 of the driving transistor 21. The capacitor 235 is coupled between the output terminal N22 of the input transistor 230 and an input terminal N23 (also referred to as a first terminal) of the transistor 233. A control terminal of the transistor 231 receives a control signal S231, an input terminal (also referred to as a first terminal) thereof is coupled to the output terminal N21 of the driving transistor 21, and an output terminal (also referred to as a second terminal) thereof is coupled to the output terminal N22 of the input transistor 230. A control terminal of the transistor 232 receives a control signal S232, an input terminal (also referred to as a first terminal) thereof is coupled to the output terminal N21 of the driving transistor 21, and an output terminal (also referred to as a second terminal) thereof is coupled to the input terminal N23 of the transistor 233. A control terminal of the transistor 233 receives a control signal S233, and an output terminal (also referred to as a second terminal) thereof is coupled to a reference ground. In the embodiment, the reference ground provides a potential of 0V.

According to the above description, the pixel unit $10_{1,2}$ receives the data signal DS1, the scan signal SS2, the reference voltage signal Ref, the switch signal S22, and the control signals S20 and S231-S233. The data signal DS1 is provided by the data driver 11 through the data line D1, and the scan signal SS2 is provided by the scan driver 12 through the scan line S2. The other signals, such as the reference voltage signal Ref, the switch signal S22, and the control signals S20 and S231-S233, are provided by the control driver 13.

In the embodiment of FIG. 2, the transistors 20-22 and 230-233 are implemented by N-type transistors for description. Each of the transistors 20-22 and 230-233 is turned on when the signal at the control terminal thereof is at a high voltage level (in the embodiment, the signal is at an enabled state) and turned off when the signal at the control terminal thereof is at a low voltage level (in the embodiment, the signal is at a disabled state).

Figure 3:
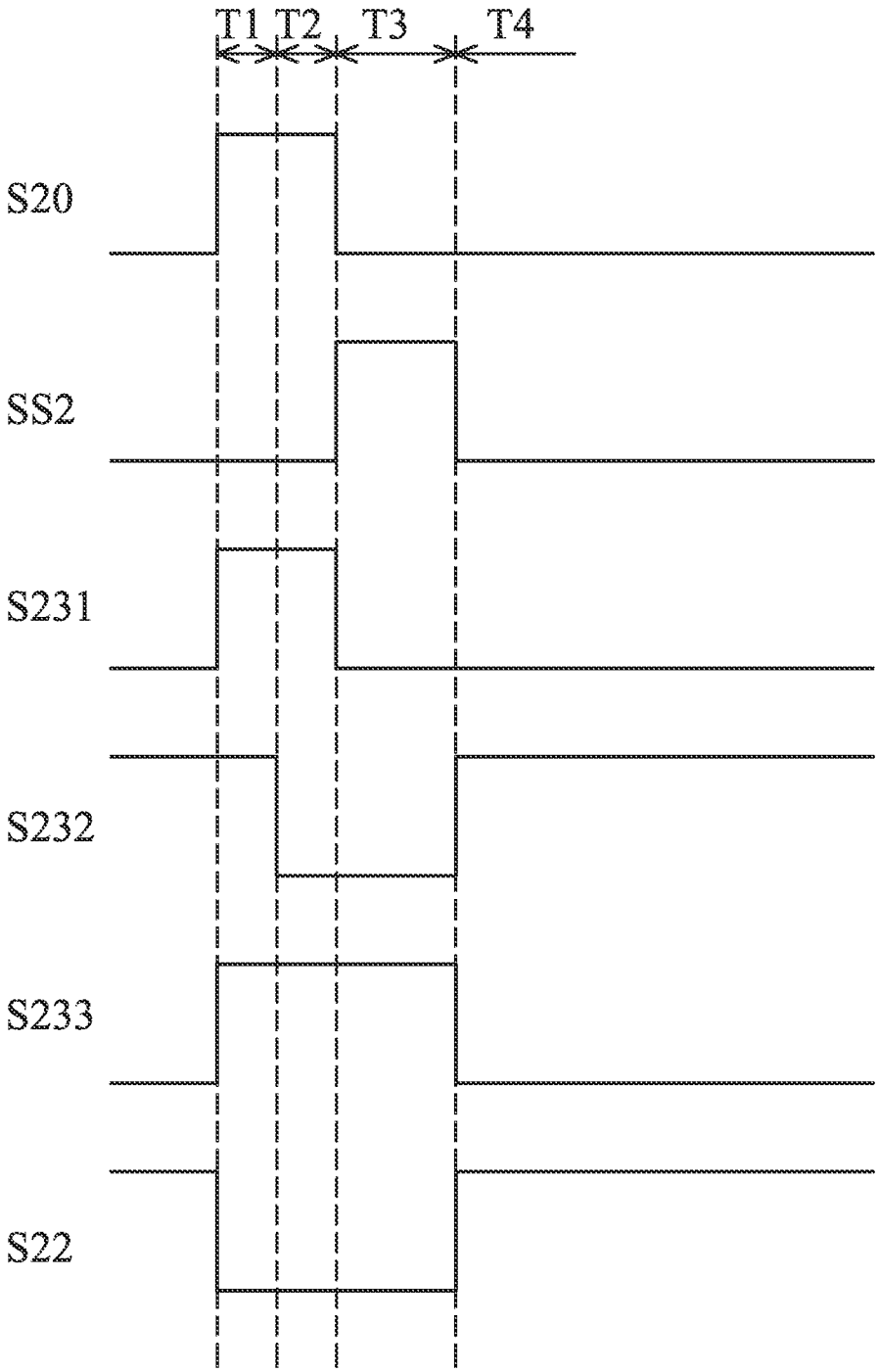
FIG. 3 is a timing chart of related signals of each display unit according to one exemplary embodiment.

According to the embodiment, the display device 1 operates in at least one display unit period to display images. FIG. 3 is a timing chart of related signals of each display unit according to one exemplary embodiment. In the embodiment of FIG. 3, each display unit period is divided into four sequential periods comprising a reset period T1, a compensation period T2, a writing period T3, and an emitting period T4. FIG. 4 shows variation of voltage levels VN20-VN23 of the terminals N20-N23 of each display unit in each display unit period. Similarly, the pixel unit $10_{1,2}$ is given as an example for illustration. Accordingly, FIG. 3 shows the data signal DS1, the scan signal SS2, the reference voltage signal Ref, the switch signal S22, and the control signals S20 and S231-S233 related to the pixel unit $10_{1,2}$.

In the following, one display unit period is given as an example for illustration with reference to FIGS. 2-4. First, in the reset period T1, the control signals S20, S231, S232, and S233 are at a high voltage level (that is at an enabled state), while the scan signal SS2 and the switch signal S22 are at a low voltage level (that is at a disabled state). Thus, the reset transistor 20 and the transistors 231, 232, and 233 are turned on, while the input transistor 230 and the switch transistor 22 are turned off. At this time, through the turned-on reset transistor 20, the voltage level VN20 of the terminal N20 (that is the control terminal of the driving transistor 21) is equal to a voltage level VRef of the reference voltage signal Ref Since the transistors 231-233 are turned on, the voltage levels of the terminals N21-N23 (that is the output terminal of the driving transistor 21, the output terminal of the input transistor 230, and the input terminal of the transistor 233 respectively) are equal to 0V (the potential of the reference ground).

Then, in the compensation period T2, the control signal S232 is switched to the low voltage level (that being switched to the disabled state) from the high voltage level, so that the transistor 232 is switched to be turned off. The control signals S20, S231, and S233 remain at the high voltage level (that is remaining the enabled state), and the scan signal SS2 and the switch signal S22 remain at the low voltage level (that is remaining the disabled state). Thus, the reset transistor 20 and the transistors 231 and 233 are turned on continuously, and the input transistor 230 and the switch transistor 22 are turned off continuously. At this time, since the reset transistor 20 and the transistor 233 are turned on, the voltage level VN20 of the terminal N20 is still equal to the voltage level VRef of the reference voltage signal Ref, and the voltage level VN23 of the terminal N23 is still equal to 0V. Note that, in the compensation period T2, the voltage level VN21 of the terminal N21 is changed to be equal to the difference (VRef−Vt) between the voltage level VRef of the reference voltage signal Ref and the threshold voltage Vt of the driving transistor 21. Through the turned-on transistor 231, the voltage level VN22 of the terminal N22 is changed to be equal to (VRef−Vt). Since the voltage level VN20 of the terminal N20 is equal to the voltage level VRef of the reference voltage signal Ref and the voltage level VN22 of the terminal N22 is equal to (VRef−Vt), the difference between the voltage level VN20 of the terminal N20 and the voltage level VN22 of the terminal N22 is equal to the threshold voltage Vt, and the threshold voltage Vt is stored in the capacitor 234. According to the above description, in the compensation period T2, the control unit 23 obtains the threshold voltage Vt of the driving transistor 21 according to the voltage level VN21 of the terminal N21 and stores the obtained threshold voltage Vt into the capacitor 234.

In the writing period T3 following the compensation period T2, the control signals S20 and S231 are switched to the low voltage level from the high voltage level, so that the reset transistor 20 and the transistor 231 is switched to be turned off. The scan signal SS2 is switched to the high voltage level from the low voltage level, so that the input transistor 230 is switched to be turned on. Moreover, since the control signal S233 remains at the high voltage level and the control signal S232 and the switch signal S22 remain at the low voltage level, the transistor 233 is turned on continuously, and the transistor 232 and the switch transistor 22 are turned off continuously. At this time, since the transistor 233 is turned on, the voltage level VN23 is still equal to 0V. In the writing period T3, the input transistor 230 is turned on, and, thus, the data signal DS1 is transmitted to the terminal N22, so that the voltage level VN22 of the terminal N22 is changed to be equal to the voltage level VDS1 of the data signal DS1. Since the capacitor 234 stores the threshold voltage Vt, through the coupling of the capacitor 234, the voltage level VN20 of the terminal N20 is changed to be equal to the sum (VDS1+Vt) of the voltage level VDS1 of the data signal DS1 and the threshold voltage Vt. Note that the voltage level (VDS1+Vt) is referred to as a writing level. At this time, the terminal N21 is at a floating state, and, thus, the voltage level VN21 of the terminal N21 is changed with the variation of the voltage level VDS1 of the data signal DS1. In the writing period T3 of FIG. 4, the voltage level VN21 of the terminal N21 is represented by "F" to indicate the floating state. Moreover, in the writing period T3, since the voltage level VN22 of the terminal N22 is equal to the voltage level VDS1 of the data signal DS1 and the voltage level VN23 of the terminal N23 is equal to 0V, the difference between the voltage level VN22 of the terminal N22 and the voltage level VN23 of the terminal N23 is equal to the voltage level VDS1 of the data signal DS1, and the voltage level VDS1 of the data signal DS1 is stored into the capacitor 235.

After the writing period T3, the display unit 1 enters the emitting period T4. In the emitting period T4, the scan signal SS2 and the control signal S233 are switched to the low voltage level form the high voltage level, so that the input transistor 230 and the transistor 233 are switched to be turned off. The control signal S232 and the switch signal S22 are switched to the high voltage level from the low voltage level, so that the transistor 232 and the switch transistor 22 are switched to be turned on. Moreover, since the control signal S20 remains at the low voltage level, the reset transistor 20 is turned off continuously. At this time, since the switch transistor 22 is turned on, the voltage level VN21 of the terminal N21 is changed to be equal to the driving voltage Voled of the OLED 24. Through the turned-on transistor 232 and the turned-off transistor 233, the voltage level VN23 of the terminal N23 is changed to be equal to the driving voltage Voled. Accordingly, the control unit 23 obtains the driving voltage Voled of the OLED 24 according to the voltage level VN21 of the terminal N21. Since the capacitor 235 stores the voltage level VDS1 of the data signal DS1, through the coupling of the capacitor 235, the voltage level VN22 of the terminal N22 is changed to be equal to (VDS1+Voled). Then, through the coupling of the capacitor 234, the voltage level VN20 of the terminal N20 is changed to be equal to (VDS1+Voled+Vt), wherein the voltage level (VDS1+Voled+Vt) is referred to as an emitting level. That is, the emitting level is equal to the sum of the writing level (VDS1+Vt) and the driving voltage Voled.

In the emitting period T4, the driving transistor 21 generates a driving current Id according to the voltage levels VN20 and VN21 of the terminals N20 and N21 to drive the OLED 24 through the switch transistor 22. The driving current Id can be calculated by the following equation:

$$\begin{aligned} Id &= K*(Vgs-Vt)^2 \\ &= K*(VN20-VN21-Vt)^2 \\ &= K*(VDS1+Voled+Vt-Voled-Vt)^2 \\ &= K*VDS1^2 \end{aligned}$$

wherein Vgs represents the gate-source voltage of the driving transistor 21.

According to the above description the driving current Id generated by the driving transistor 21 is irrelevant to the threshold voltage Vt of the driving transistor 21 and the driving voltage Voled of the OLED 24.

According to the display device 1 of the embodiment, the control unit 23 compensates for characteristics where the threshold Vt and the driving voltage Voled vary as time goes by. Thus, when the threshold voltage Vt and the driving voltage Voled vary as operation time of the display device 1 increases, the driving current Id generated by the driving transistor 21 is not affected by the variation, thereby preventing the display device 1 from the mura phenomenon.

Moreover, in the embodiment, the voltage level Vref of the reference voltage signal Ref is determined by the characteristics of the display device 1, for example, according to the value of the threshold voltage Vt of the driving transistor 21 of the display device 1. In some embodiments, if the value of the threshold voltage Vt is negative, the voltage level VRef of the reference voltage source Ref is set to be lower than the difference (vdd−|Vt|) between the voltage vdd provided by the operation voltage source VDD and the absolute value of the threshold voltage Vt. In other some embodiments, if the value of the threshold voltage Vt is positive, the voltage level VRef of the reference voltage source Ref is set to be lower than the sum (vdd+Vt) of the voltage vdd provided by the operation voltage source VDD and the threshold voltage Vt. In the case, for circuit systems, the voltage vdd provided by the operation voltage source VDD is generally the largest voltage. Thus, in other words, the voltage level VRef of the reference voltage source Ref is set to be lower than or equal to the voltage vdd provided by the operation voltage source VDD. Accordingly, no matter whether the value of threshold voltage Vt of the driving transistor 21 is positive or negative, the control unit 23 can perform the compensation function related to the threshold voltage Vt.

Figure 5:
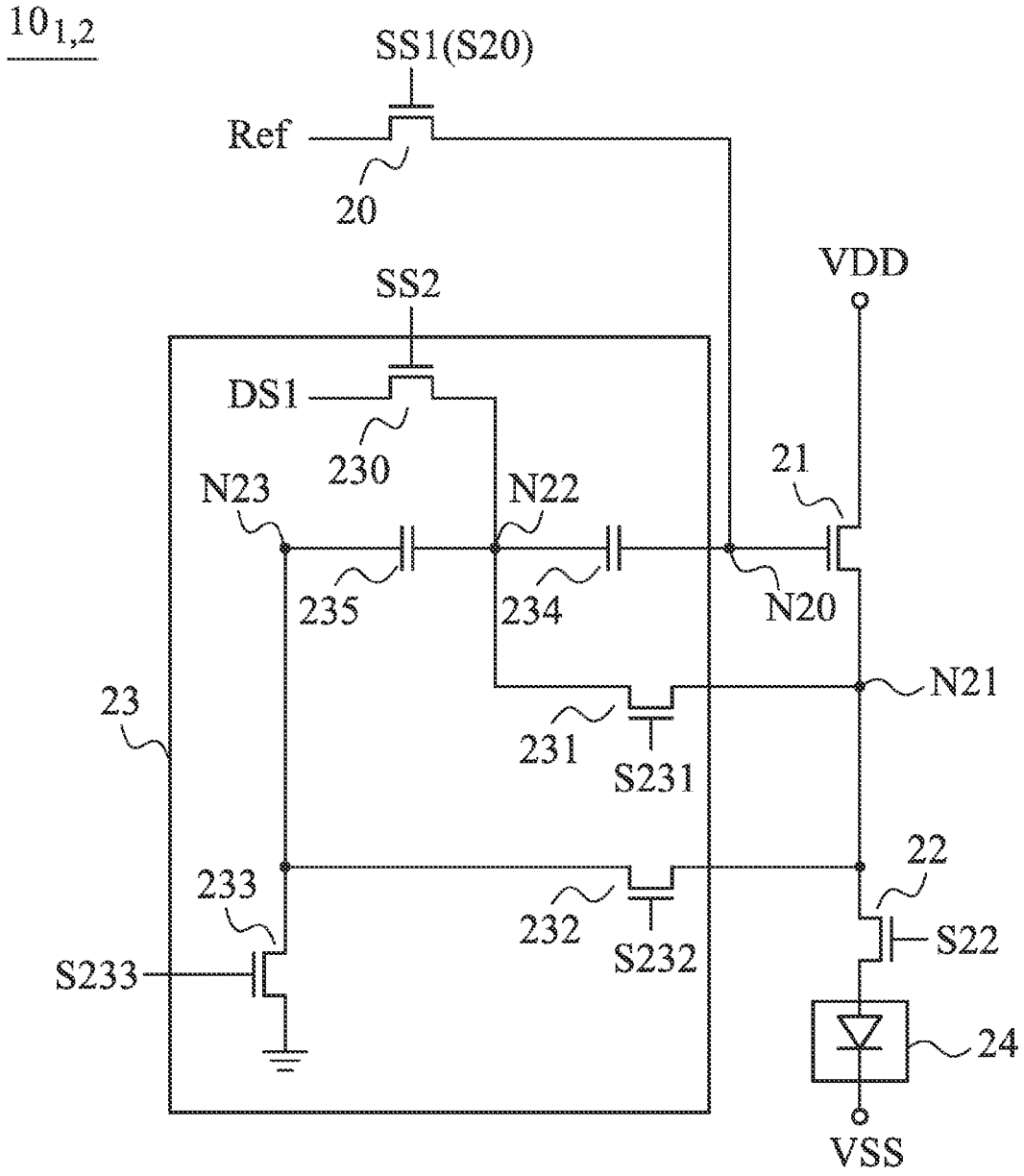
FIG. 5 shows another exemplary embodiment of a pixel unit.

Referring to FIG. 4, the control signal S20 and the scan signal SS2 are enabled sequentially; that is, the control signal S20 and the scan signal SS2 are at the high voltage level sequentially. The control signal S20 is enabled in the reset period T1 and the compensation period T2, and the scan signal SS2 is enabled in the writing period T3 and the emitting period T4. In one embodiment, it is assumed that the sum of the lengths of the reset period T1 and the compensation period T2 is equal to the length of the writing period T3 (T1+T2=T3). As the above describes, the scan signals SS1-SSn are enabled sequentially. Further, the lengths of the periods when the respective scan signals SS1-SSn are enabled are equal, and these periods do not overlap. In an assumed case, the timing of the control signal S20 is the same as the timing the scan signal SS1 of the scan line S1. Thus, in the embodiment, for the pixel row where the pixel unit $\mathbf{10}_{1,2}$ is arranged, the scan signal SS1 of the scan line S1 on the previous pixel row can be transmitted to the control terminal of the reset transistor 20 of the pixel unit $\mathbf{10}_{1,2}$ to serve the control signal S20. In other words, the control terminal of the reset transistor 20 of the pixel unit $\mathbf{10}_{1,2}$ is coupled to the scan line S1 which the adjacent pixel unit $\mathbf{10}_{1,1}$ is coupled to, as shown in FIG. 5. Referring to FIG. 1 again, the pixel units $\mathbf{10}_{1,1}$ and $\mathbf{10}_{1,2}$ are arranged in the same pixel column and coupled to the data line D1 to receive the data signal DS1. Moreover, the pixel units $\mathbf{10}_{1,1}$ and $\mathbf{10}_{1,2}$ are arranged in two adjacent pixel rows and coupled to the scan lines S1 and S2 to receive the scan signals SS1 and SS2, which are enabled sequentially, respectively. In the embodiment of FIG. 5, since the scan line SS1 serves as the control signal S20, the control driver 13 can not generate the control signal S20.

Figure 6:
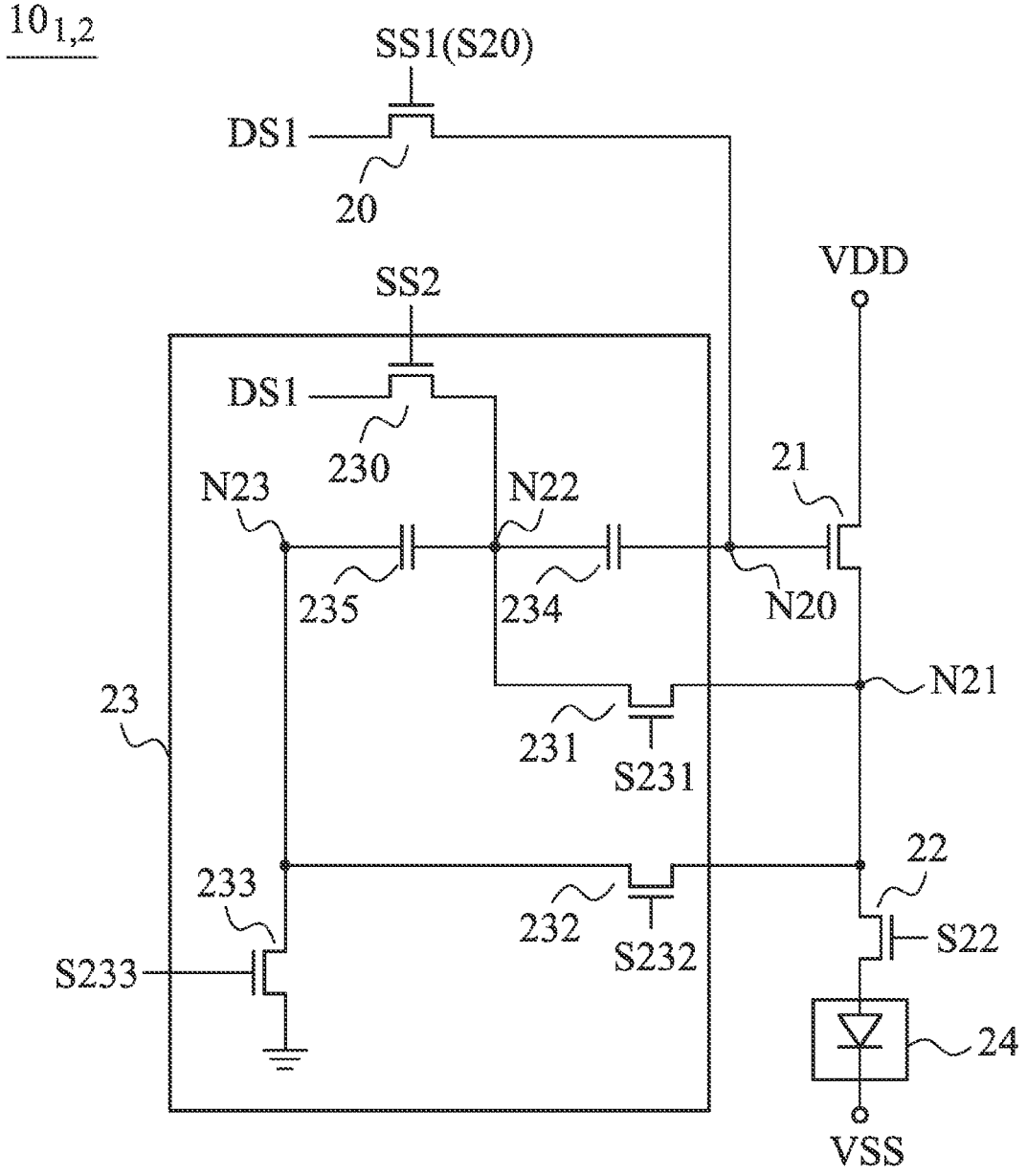
FIG. 6 shows another exemplary embodiment of a pixel unit.

In other embodiments, in the case when the sum of the lengths of the reset period T1 and the compensation period T2 is equal to the length of the writing period T3 (T1+T2=T3), the scan signal SS1 is transmitted to the control terminal of the reset transistor 20 of the pixel unit $\mathbf{10}_{1,2}$ to serve as the control signal S20, and the data signal DS1 is transmitted to the input terminal of the reset transistor 20 of the pixel unit $\mathbf{10}_{1,2}$ to serve as the reference voltage signal Ref. In other words, the input terminal of the reset transistor 20 of the pixel unit $\mathbf{10}_{1,2}$ is coupled to the common data line D1 which both of the pixel units $\mathbf{10}_{1,1}$ and $\mathbf{10}_{1,2}$ are coupled to (that is the corresponding data line D1 which the pixel unit $\mathbf{10}_{1,2}$ is coupled to), as shown in FIG. 6. In the embodiment of FIG. 6, if the value of the threshold voltage Vt is negative, the voltage levels of the data signal DS1-DSm are set to be lower than the difference (vdd−|Vt|) between the voltage vdd provided by the operation voltage source VDD and the absolute value of the threshold voltage Vt. If the value of the threshold voltage Vt is positive, the voltage levels of the data signal DS1-DSm are set to be lower than the voltage vdd provided by the operation voltage source VDD. Moreover, since the data signal DS1 serves as the reference voltage signal Ref, the control driver 13 further can not generate the reference voltage signal Ref.

Figure 7:
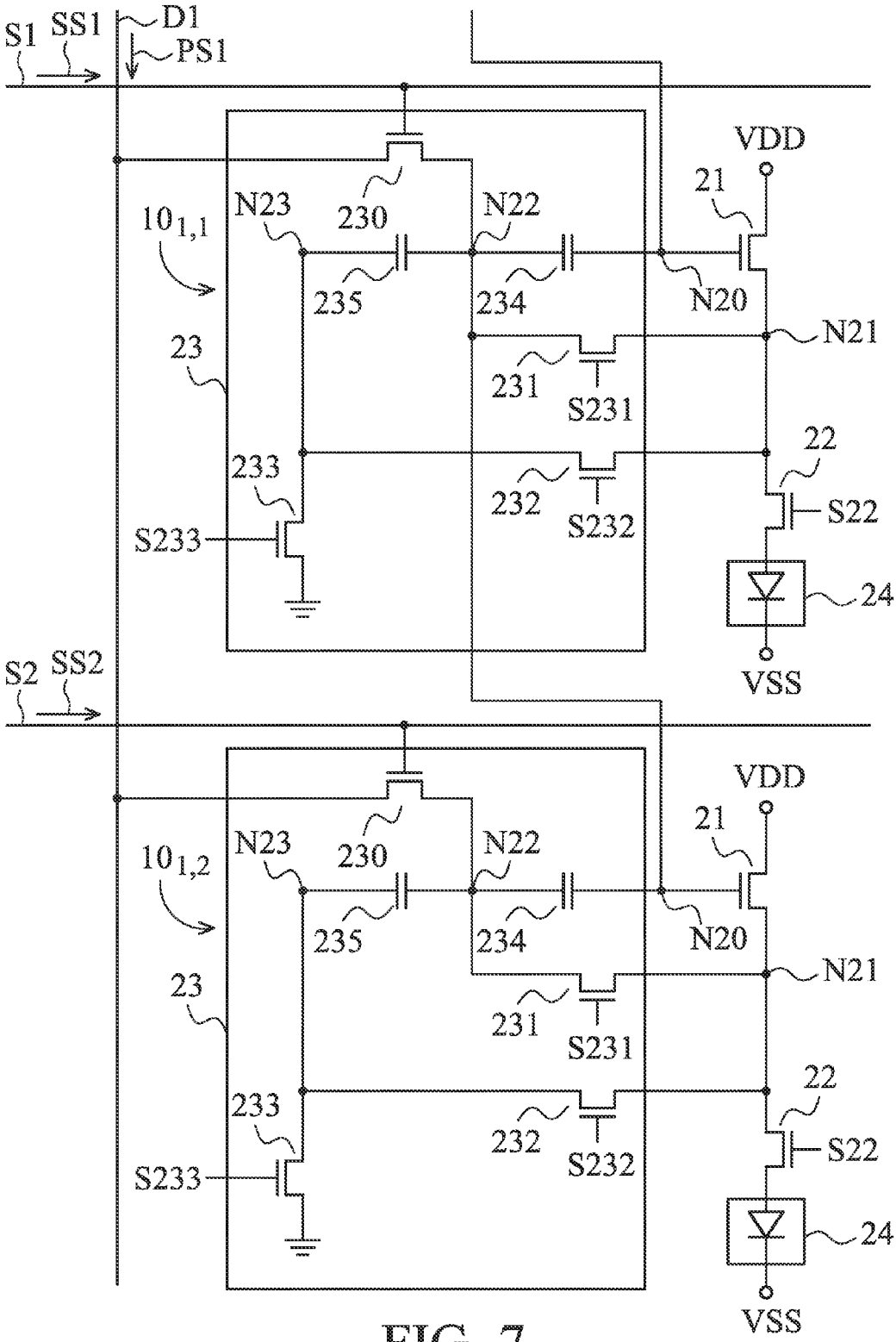
FIG. 7 shows further another exemplary embodiment of a pixel unit.

In the embodiment of FIG. 6, the reset transistor 20 of the pixel unit $\mathbf{10}_{1,2}$ is controlled by the scan signal SS1 of the scan line S1 on the previous pixel row and receives the data signal DS1 of the data line D1 where the pixel unit $\mathbf{10}_{1,2}$ is coupled. Referring to FIG. 6, the connection of the control terminal and the input terminal of the reset transistor 20 of the pixel unit $\mathbf{10}_{1,2}$ is same as the connection of the control terminal and the input terminal of the input transistor 230 of the pixel unit $\mathbf{10}_{1,2}$. Thus, in other embodiments, the terminal N20 of the pixel unit $\mathbf{10}_{1,2}$ is coupled to the output terminal of the input transistor 230 of the pixel unit $\mathbf{10}_{1,1}$, thereby omitting the reset transistor 20, as shown in FIG. 7. The terminal N20 of each of the pixel units arranged on the first pixel row receives an additional control signal. The additional control signal and the scan signal SS1 are enabled sequentially, and the periods when the additional control signal and the scan signal SS1 are enabled do not overlap. For example, the terminal N20 of the pixel unit $\mathbf{10}_{1,1}$ arranged in the first pixel row can receive an additional control signal. In the embodiment of FIG. 7, one transistor (the reset transistor) is omitted for each pixel unit, and, thus, the size of each of the pixel units is decreased, thereby reducing the area of the display array.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device comprising:

a plurality of data lines transmitting a plurality of data signals, respectively;

a plurality of scan lines transmitting a plurality of scan signals, respectively, wherein the scan lines are interlaced with the data lines, and the scan signals are enabled sequentially; and a display array comprising a plurality of pixel units arranged in a matrix formed by a plurality of pixel rows and a plurality of pixel columns, wherein each pixel unit is coupled to a set of the interlaced data line and scan line to receive the corresponding data signal and the corresponding scan signal, wherein the pixel units arranged on the same pixel column are coupled to the same data line, and the pixel units arranged on the same pixel row are coupled to the same scan line, and wherein each pixel unit comprises:

a driving transistor having a control terminal, a first terminal coupled to a first operation voltage source, and a second terminal and further having a threshold voltage;

a switch transistor coupled to the second terminal of the driving transistor;

a light-emitting element having a driving voltage and coupled to the switch transistor in series between the second terminal of the driving transistor and a second operation voltage source; and a control unit coupled to the control terminal and the second terminal of the driving transistor and receiving the corresponding data signal, wherein the control unit stores the threshold voltage and the driving voltage according to a voltage level of the second terminal of the driving transistor and changes a voltage level of the control terminal of the driving transistor according to the stored threshold voltage, the stored driving voltage, and the corresponding data signal, wherein the control unit comprises:

an input transistor having a control terminal coupled to the corresponding scan line and receiving the corresponding scan signal, a first terminal coupled to the corresponding data line and receiving the corresponding data signal, and a second terminal;

a first transistor having a control terminal receiving a first control signal, a first terminal coupled to the second terminal of the driving transistor, and a second terminal coupled to the second terminal of the input transistor;

a second transistor having a control terminal receiving a second control signal, a first terminal coupled to the second terminal of the driving transistor, and a second terminal;

a third transistor having a control terminal receiving a third control signal, a first terminal coupled to the second terminal of the second transistor, and a second terminal coupled to a reference ground;

a first capacitor coupled between the second terminal of the input transistor and the control terminal of the driving transistor; and a second capacitor coupled between the second terminal of the input transistor and the first terminal of the third transistor;

wherein during a reset period, the input transistor is turned off according to the corresponding disabled scan signal, the switch transistor is turned off according to a switch signal, and the first, second, and third transistors are turned on according to the first, second, and third control signals, respectively, wherein during a compensation period following the reset period, the second transistor is switched to be turned off according to the second control signal, wherein during a writing period following the compensation period, the input transistor is switched to be turned on according to the corresponding enabled scan signal, and the first transistor is switched to be turned off according to the first control signal, wherein during an emitting period following the writing period, the input transistor is switched to be turned off according to the corresponding disabled scan signal, the switch transistor is switched to be turned on according to the switch signal, the second transistor is switched to be turned on according to the second control signal, and the third transistor is switched to be turned off according to the third control signal, and wherein in the emitting period, the driving transistor generates a driving current according to the voltage level of the control terminal of the driving transistor and the voltage level of the second terminal of the driving transistor to drive the light-emitting element.

2. The display device as claimed in claim 1, wherein during a reset period, the voltage level of the control terminal of the driving transistor is set to be equal to a voltage level of a reference voltage signal, wherein during a compensation period following the reset period, the control unit stores the threshold voltage according to the voltage level of the second terminal of the driving transistor, wherein during a writing period following the compensation period, the control unit controls the voltage level of the control terminal of the driving transistor to be equal to a writing level, and the writing level is equal to the sum of a voltage level of the corresponding data signal and a level of the threshold voltage, and wherein during an emitting period following the writing period, the switch transistor is turned on and drives the voltage level of the second terminal of the driving transistor to be equal to the driving voltage, and the control unit controls the voltage level of the control terminal of the driving transistor to be equal to an emitting level, which is equal to the sum of the writing level and the driving voltage, according to the voltage level of the second terminal of the driving transistor, and the driving transistor generates a driving current according to the voltage level of the control terminal of the driving transistor and the voltage level of the second terminal of the driving transistor to drive the light-emitting element.

3. The display device as claimed in claim 1, wherein the voltage level of a reference voltage signal is lower than the sum of a voltage provided by the first operation voltage source and the threshold voltage.

4. The display device as claimed in claim 1, wherein the light-emitting element is an organic light-emitting diode, an anode of the organic light-emitting diode is coupled to the switch transistor, and a cathode of the organic light-emitting diode is coupled to the second operation voltage source.

5. The display device as claimed in claim 1, wherein each pixel unit further comprises a reset transistor having a control terminal receiving a fourth control signal, a first terminal receiving a reference voltage signal, and a second terminal coupled to the control terminal of the driving transistor, wherein in the reset period and the compensation period, the fourth control signal is enabled to turn on the reset transistor to set the control terminal of the driving transistor to be at a voltage level of the reference voltage signal, and wherein in the writing period and the emitting period, the fourth control signal is disabled to turn off the reset transistor.

6. The display device as claimed in claim 5, wherein a control terminal of the reset transistor is coupled to the scan line where an adjacent pixel unit is coupled to receive the scan signal corresponding to the adjacent pixel unit to serve as the fourth control signal, and wherein the adjacent pixel unit and the pixel are coupled to the same data line and respectively to two adjacent scan lines, and the scan signals of the scan lines wherein the adjacent pixel unit and the pixel unit are coupled are enabled sequentially.

7. The display device as claimed in claim 6, wherein a first terminal of the reset transistor is coupled to the data line where the pixel unit is coupled, and when the reset transistor is turned on, the corresponding data signal serves as the reference voltage signal and is transmitted to the control terminal of the driving transistor.

* * * * *